US011421500B2

(12) United States Patent
Kinkaid et al.

(10) Patent No.: US 11,421,500 B2
(45) Date of Patent: Aug. 23, 2022

(54) PIPE DIAMETER REDUCTION LOCK-DOWN SYSTEM

(71) Applicant: POWER FEED THRU SYSTEMS AND CONNECTORS LLC, Deer Park, TX (US)

(72) Inventors: Roy Kinkaid, Humble, TX (US); Brandon Marbach, Spring, TX (US)

(73) Assignee: Power Feed Thru Systems and Connectors, LLC, Deer Park, TX (US)

( * ) Notice: Subject to any disclaimer, the term of this patent is extended or adjusted under 35 U.S.C. 154(b) by 0 days.

(21) Appl. No.: 17/085,879

(22) Filed: Oct. 30, 2020

(65) Prior Publication Data

US 2021/0131213 A1 May 6, 2021

Related U.S. Application Data

(60) Provisional application No. 62/928,119, filed on Oct. 30, 2019.

(51) Int. Cl.
*E21B 33/04* (2006.01)

(52) U.S. Cl.
CPC ..... *E21B 33/04* (2013.01)

(58) Field of Classification Search
CPC ..... E21B 33/04
See application file for complete search history.

(56) References Cited

U.S. PATENT DOCUMENTS

| | | | | |
|---|---|---|---|---|
| 3,494,638 | A * | 2/1970 | Todd | E21B 33/03 285/93 |
| 3,897,040 | A * | 7/1975 | Le Rouax | E21B 33/06 251/1.2 |
| 4,214,778 | A * | 7/1980 | Diehl | E21B 33/04 166/89.2 |
| 4,278,278 | A * | 7/1981 | Chambless | E21B 33/04 166/240 |
| 2012/0012335 | A1* | 1/2012 | White | E21B 33/03 166/379 |

* cited by examiner

*Primary Examiner* — Matthew R Buck
(74) *Attorney, Agent, or Firm* — David G. Henry, Sr.; Alexander B. Uber

(57) ABSTRACT

A pipe diameter reduction lock-down system utilizing movable panels that engage with a tubing hanger upon application of force to an outer radial face of said movable panels. The movable panels are secured to a bowl reducer that is configured to seat the tubing hanger to facilitate engagement of the movable panels to the tubing hanger. Conventional lockscrews are used to apply the necessary force to the movable panels. The movable panels are further coupled to a spring such that they disengage from the tubing hanger when the lockscrews are loosened.

9 Claims, 16 Drawing Sheets

PIPE DIAMETER REDUCTION LOCK-DOWN SYSTEM

CITATION TO PRIOR APPLICATIONS

The present application claims priority to U.S. Provisional Application No. 62/928,119, titled "Pipe Diameter Reduction Lock-Down System" and filed Oct. 30, 2019.

BACKGROUND AND SUMMARY OF THE INVENTION

Conventional methods of installing a smaller hanger into a larger tubing head require the installation of a bowl reducer or parent hanger onto the smaller hanger prior the smaller hanger into the tubing hanger. Additionally, such methods require the use of a larger blowout preventer to accommodate the large diameter of the bowl reducer during the installation process.

Embodiments of the present invention utilize a mechanism coupled with a bowl reducer to provide for the translation of the lockdown function of conventional lock screws in an existing tubing head to be translated to a smaller diameter hanger. As a result, a blowout preventer with a smaller through-bore than what would be present on a conventional well may be used to land and install the smaller tubing hanger.

DETAILED DESCRIPTION OF EMBODIMENTS

To facilitate the installation of a smaller hanger, embodiments of the present invention utilize a lock-down mechanism coupled to a bowl reducer. Said lock-down mechanism comprising a plurality of movable panels, a plurality of shoulder bolts, and a spring.

Figure 1:
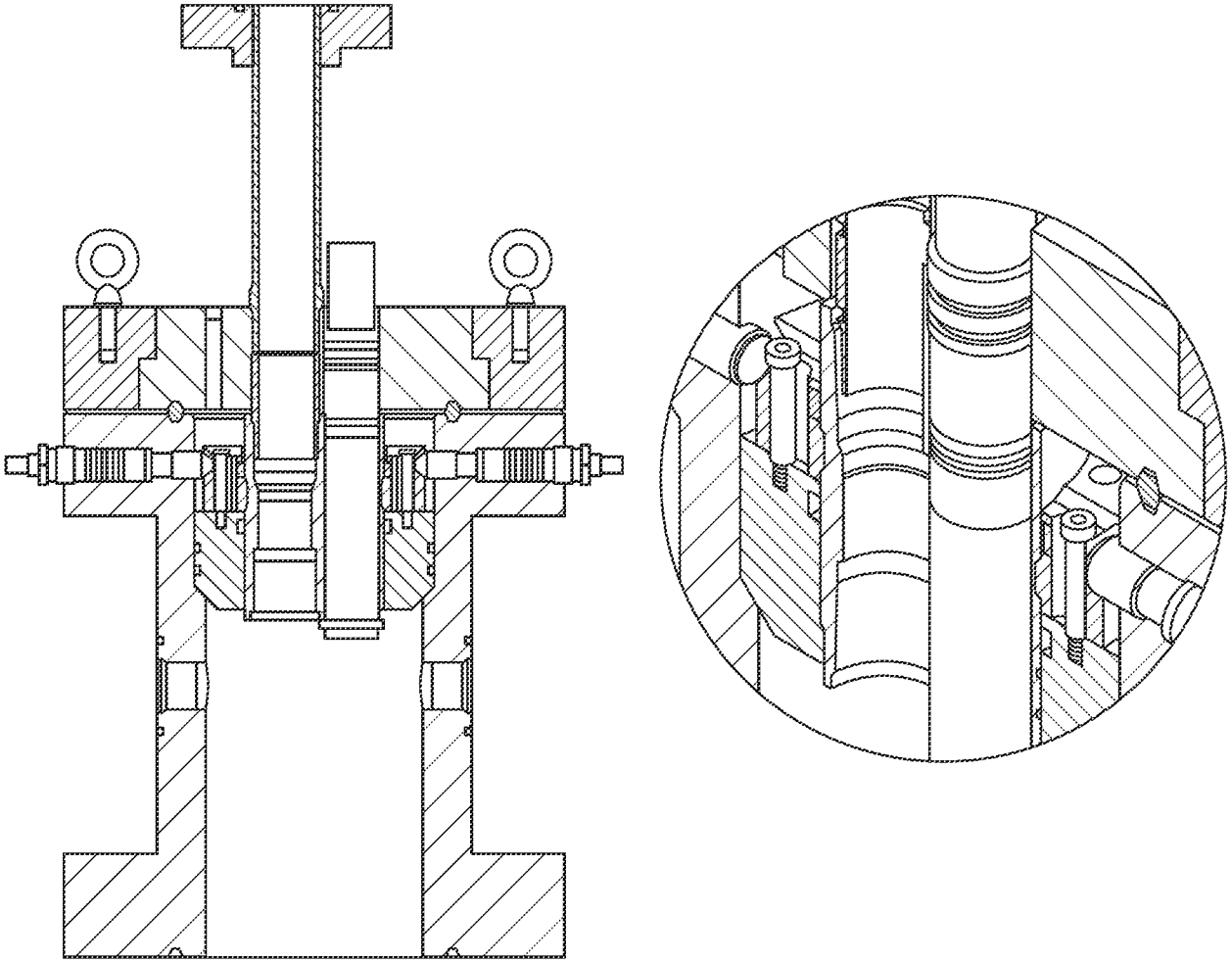
FIG. 1 is a cross-sectional view of the lock-down mechanism and bowl reducer assembly installed in a tubing head according to one embodiment of the present invention.
Figure 2:
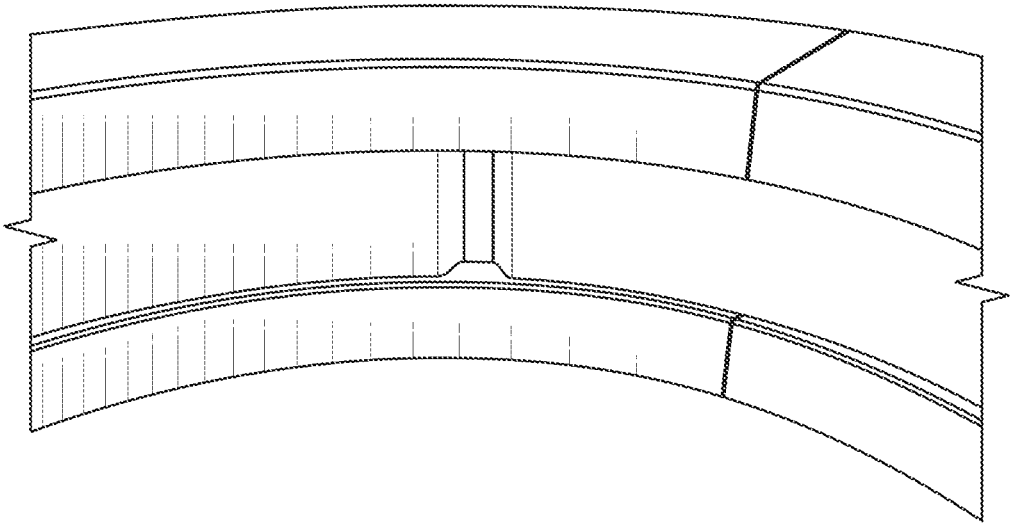
FIG. 2 is a perspective view of a spring installed in a groove of two movable panels according to one embodiment of the present invention.
Figure 3:
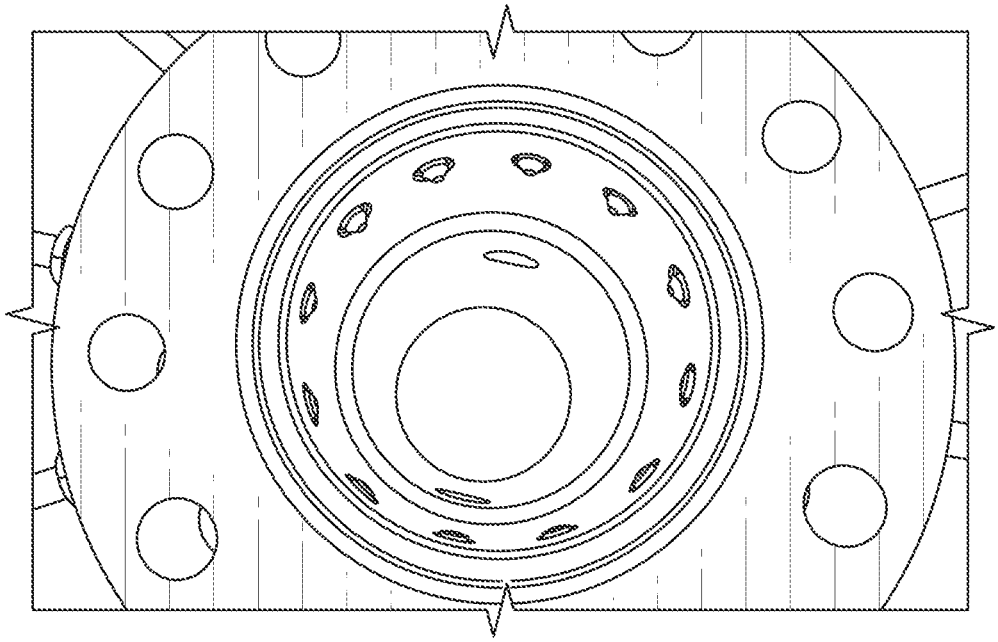
FIG. 3 is a top view of a tubing head prior to installation of a lock-down mechanism and bowl reducer assembly according to one embodiment of the present invention.
Figure 4:
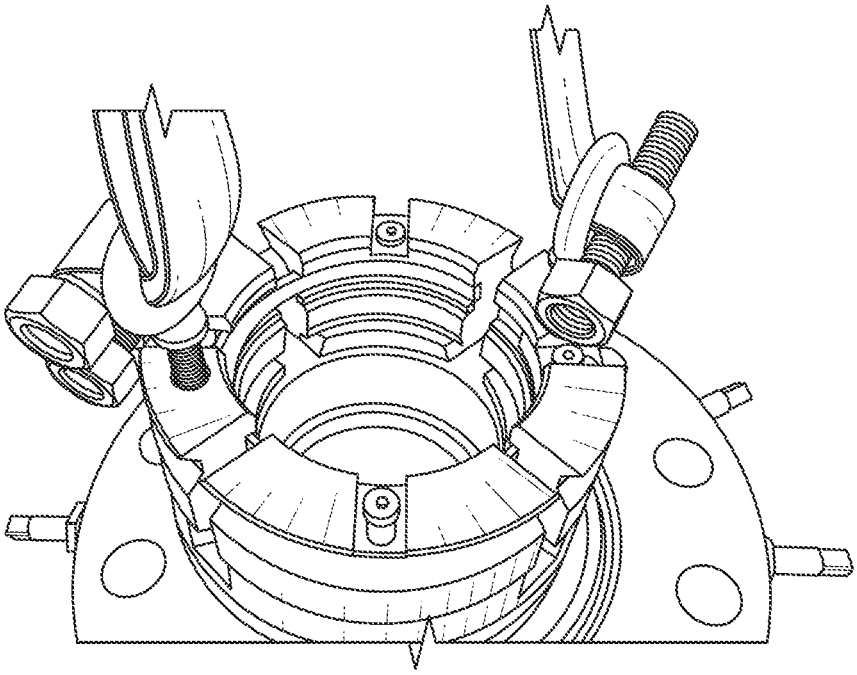
FIG. 4 is a perspective view of a lock-down mechanism and bowl reducer assembly being lifted by two eye hooks in accordance to one embodiment of the present invention.
Figure 5:
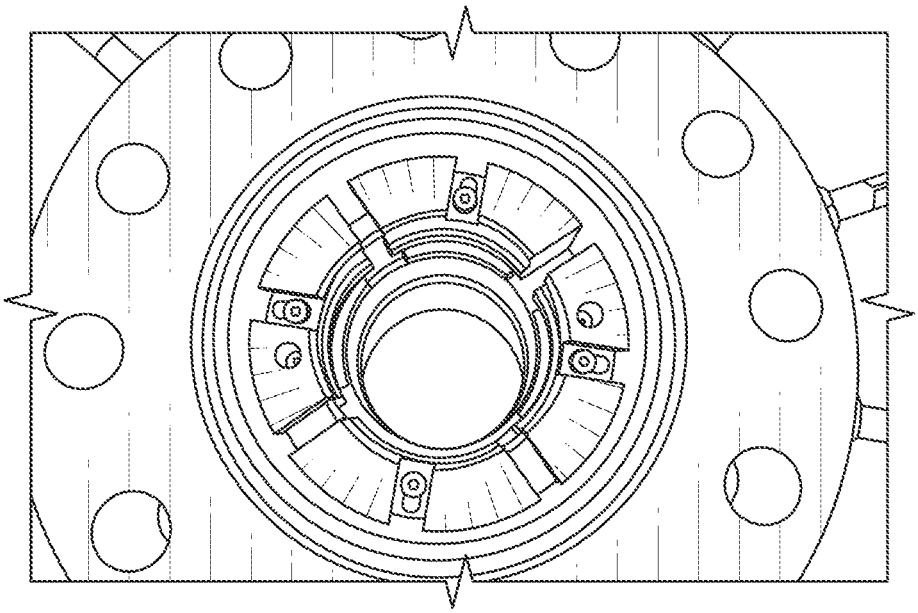
FIG. 5 is a top view of a tubing head with a lock-down mechanism and bowl reducer assembly installed according to one embodiment of the present invention.
Figure 6:
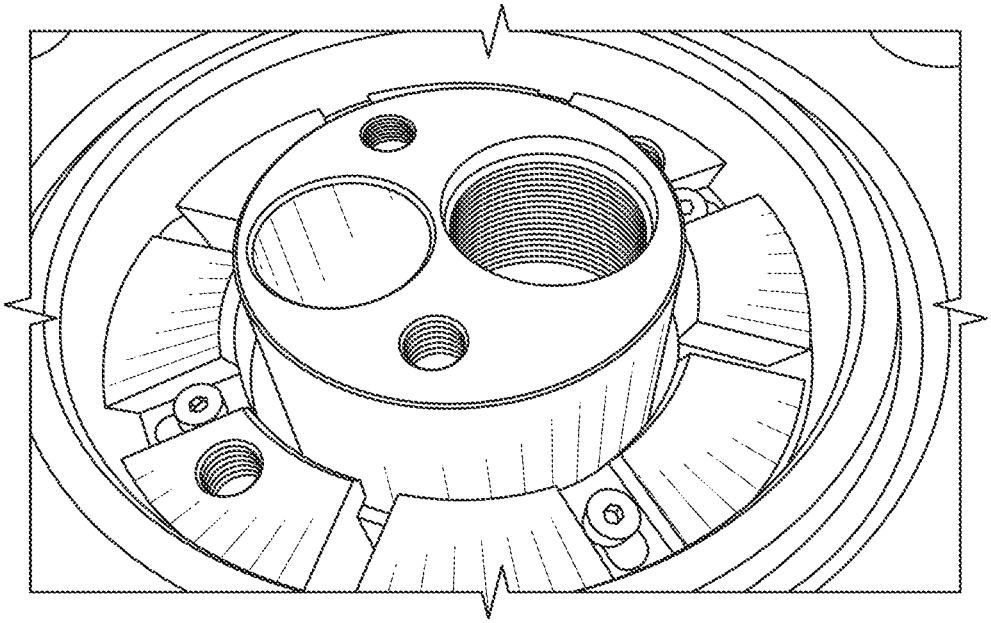
FIG. 6 is a perspective view of a tubing hanger disposed in a lock-down mechanism and bowl reducer assembly prior to engagement of the assembly's movable panels according to one embodiment of the present invention.
Figure 7:
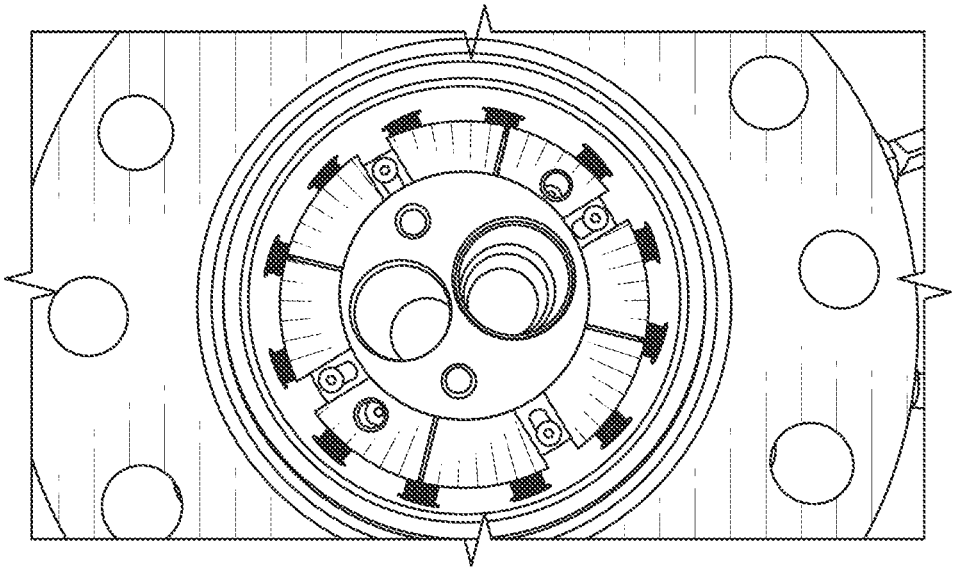
FIG. 7 is a top view of a tubing hanger disposed in a lock-down mechanism and bowl reducer assembly prior to engagement of the assembly's movable panels according to one embodiment of the present invention.
Figure 8:
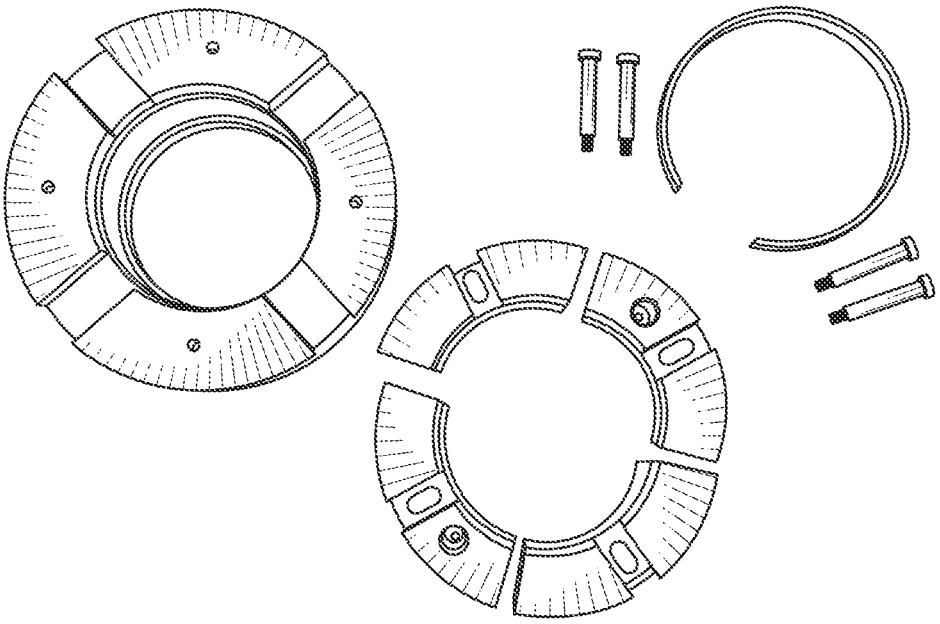
FIG. 8 is a top view of a bowl reducer, four movable panels, four shoulder bolts, and a spring according to one embodiment of the present invention.
Figure 9:
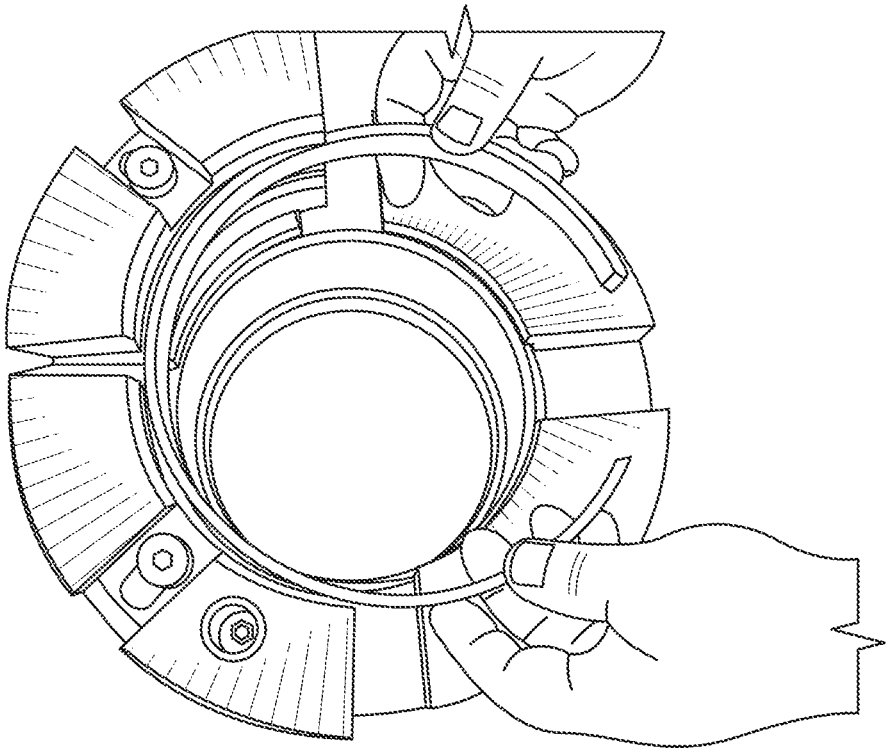
FIG. 9 is a top view of a partially assembled lock-down mechanism and bowl reducer assembly wherein two movable panels have been secured to the bowl reducer, and the spring is being fitted into the inner grooves in accordance with one embodiment of the present invention.

As depicted in FIG. 8, in certain embodiments, the plurality of movable panels are four, arc-shaped movable panels wherein each movable panel comprising a top face, a bottom face, a first lateral face, a second lateral face, an outer radial face, and an inner radial face. The movable panels may be arranged to substantially form a circle to maintain an open bore or channel in any assembly or apparatus into which the lock-down mechanism is installed. Each movable panel further comprising a bolt slot disposed axially between said top face and said bottom face, wherein said bolt slot is configured to receive one shoulder bolt of said plurality of shoulder bolts. "Axial" (or "axially") is used here to refer to an axis, or direction, as defined by the bore of a tubing head, or other interior channel of some tubing assembly or other wellhead apparatus, into which the lock-down mechanism would generally be installed.

Each movable panel may be coupled to the bowl reducer by said one shoulder bolt. Said one shoulder bolt may be inserted into and through said bolt slot. Said bowl reducer is configured to receive said shoulder bolt. Said shoulder bolt may be secured to said bowl reducer via threading on one end of said shoulder bolt that is configured to engage with corresponding threading in a bolt hole of said bowl reducer. Said bolt hole in said each movable panel may be configured to allow movement of the respective movable panel radially inward and outward, as substantially guided by said shoulder bolt and said bolt hole, when said shoulder bolt is disposed through said bolt hole and secured in said bowl reducer. "Radial" (or "radially") is used here to refer to a direction substantially orthogonal to the axis, or axial direction, previously described. Accordingly, "radially inward" refers to a position that is disposed nearer the center axis of a tubing head bore, or other interior channel of some tubing assembly or other wellhead apparatus into which the lock-down mechanism would generally be installed, relative some other position.

Figure 11:
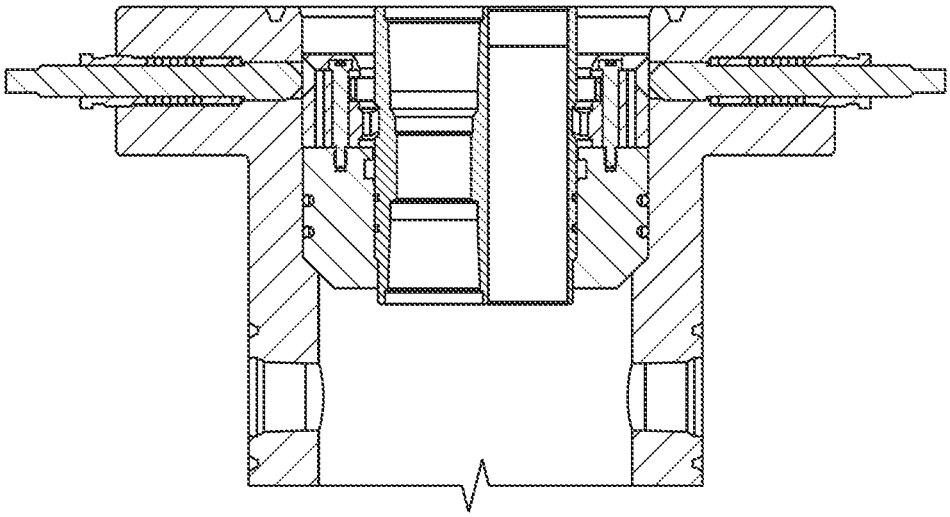
FIG. 11 is a cross-sectional side view of a lock-down mechanism and bowl reducer assembly installed in tubing head in accordance with one embodiment of the present invention.
Figure 12:
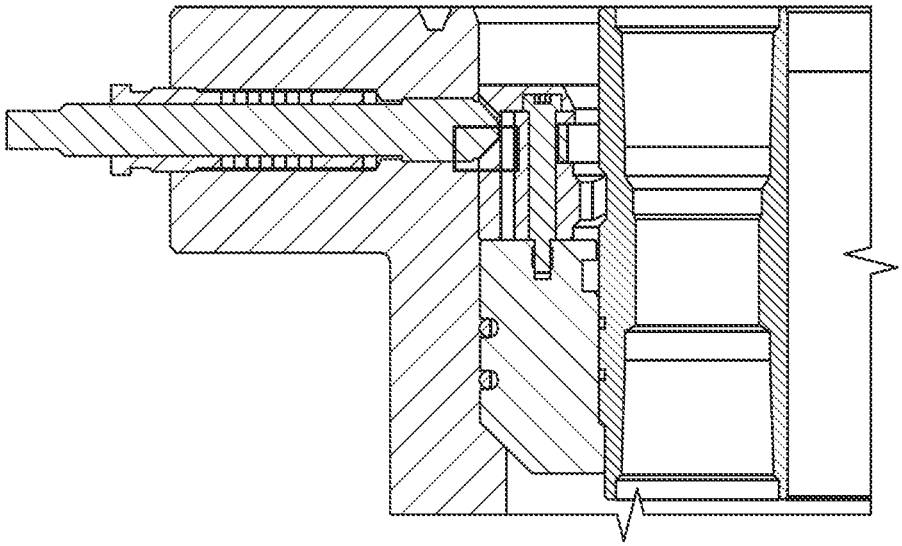
FIG. 12 is a cross-sectional side view of a lockscrew engaging with a movable panel in accordance with one embodiment of the present invention.
Figure 13:
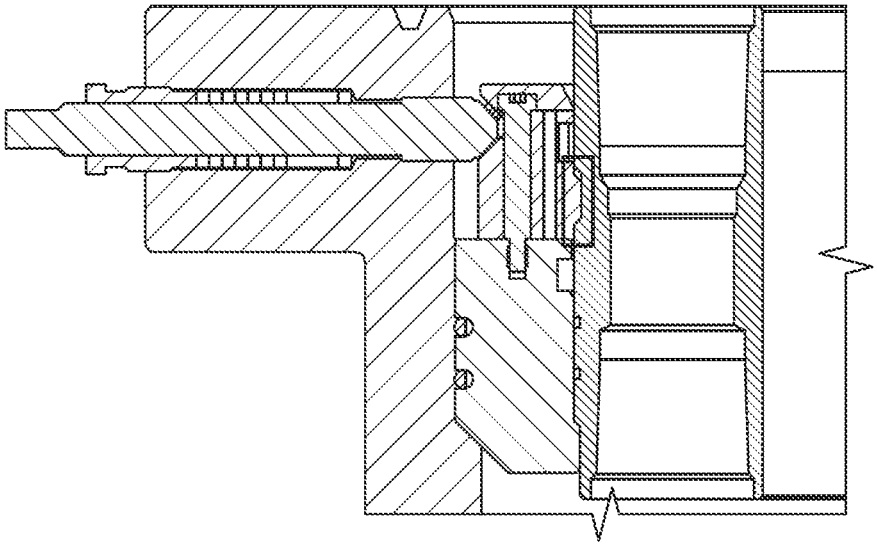
FIG. 13 is a cross-sectional side view of a movable panel engaging with a tubing hanger in accordance with one embodiment of the present invention.
Figure 14:
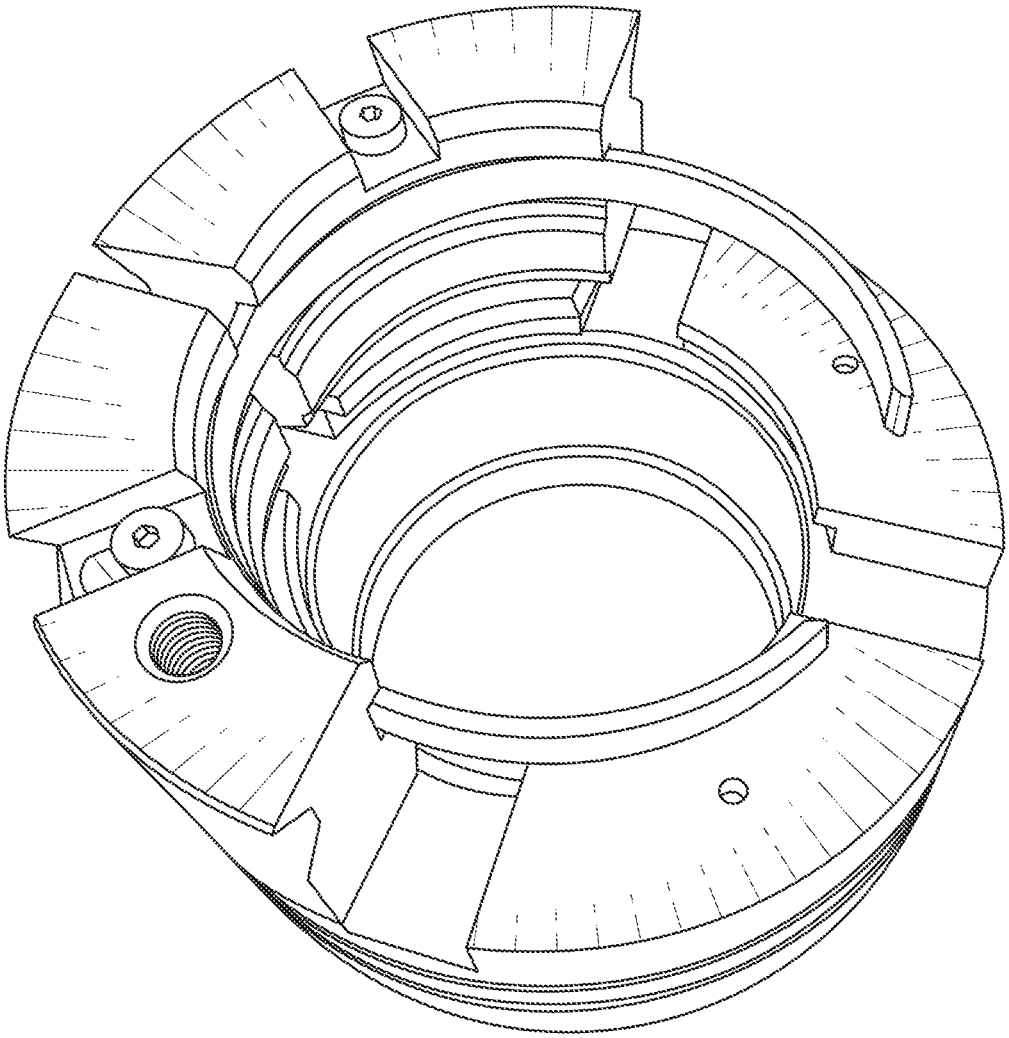
FIG. 14 is a perspective view of a partially assembled lock-down mechanism and bowl reducer assembly wherein two movable panels have been secured to the bowl reducer, and the spring is being fitted into the inner grooves in accordance with one embodiment of the present invention.
Figure 15:
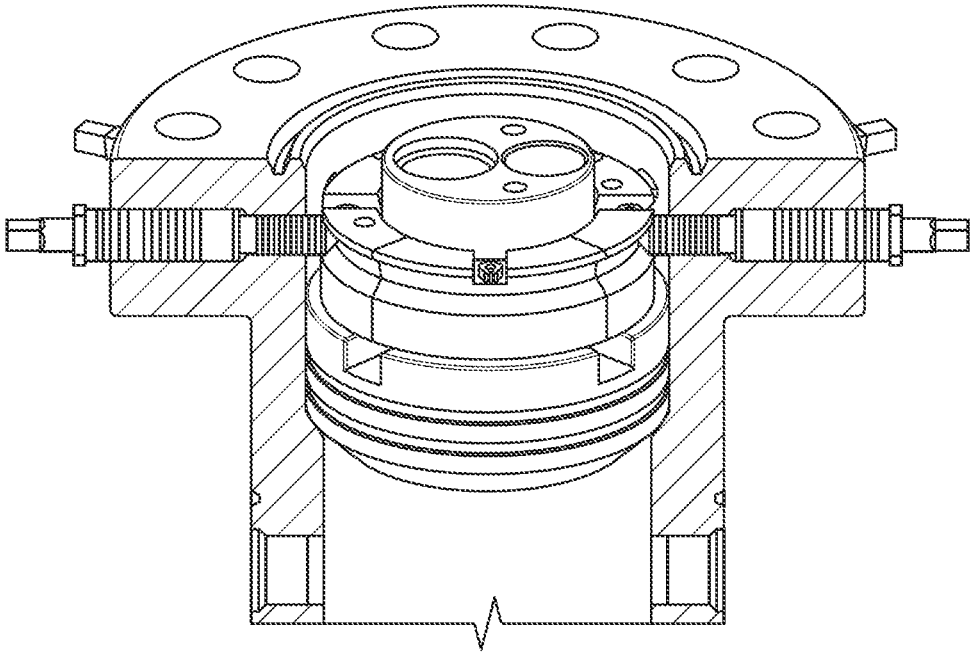
FIG. 15 is a cross-sectional perspective view of a tubing hanger secured by a lock-down mechanism and bowl reducer assembly installed in a tubing head in accordance with one embodiment of the present invention.
Figure 16:
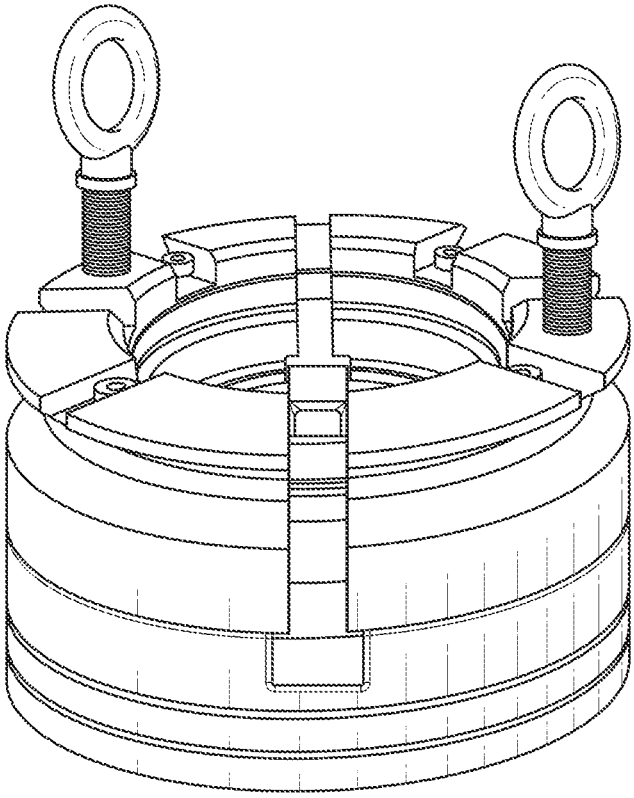
FIG. 16 is a perspective view of a lock-down mechanism and bowl reducer assembly with two eye hooks installed to facilitate installation and/or removal in accordance with one embodiment of the present invention.
Figure 17:
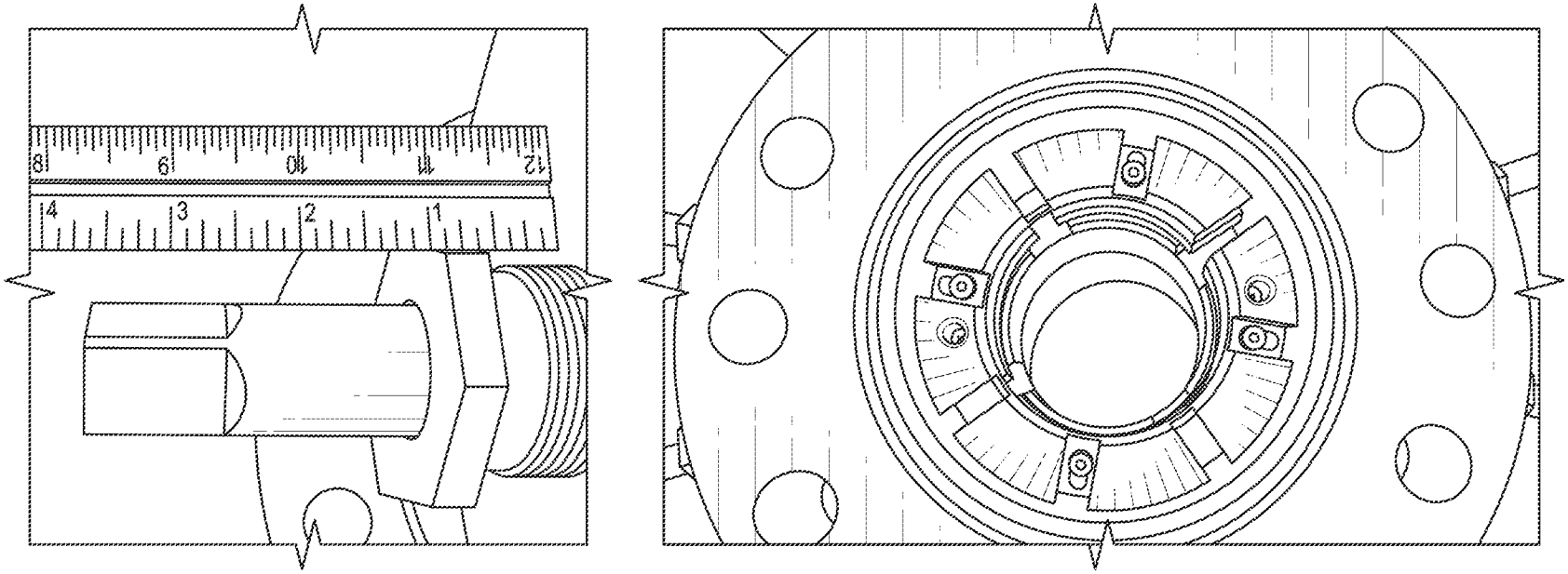
FIG. 17 is a top view of a lock-down mechanism and bowl reducer assembly installed in a tubing head in accordance with one embodiment of the present invention.
Figure 18:
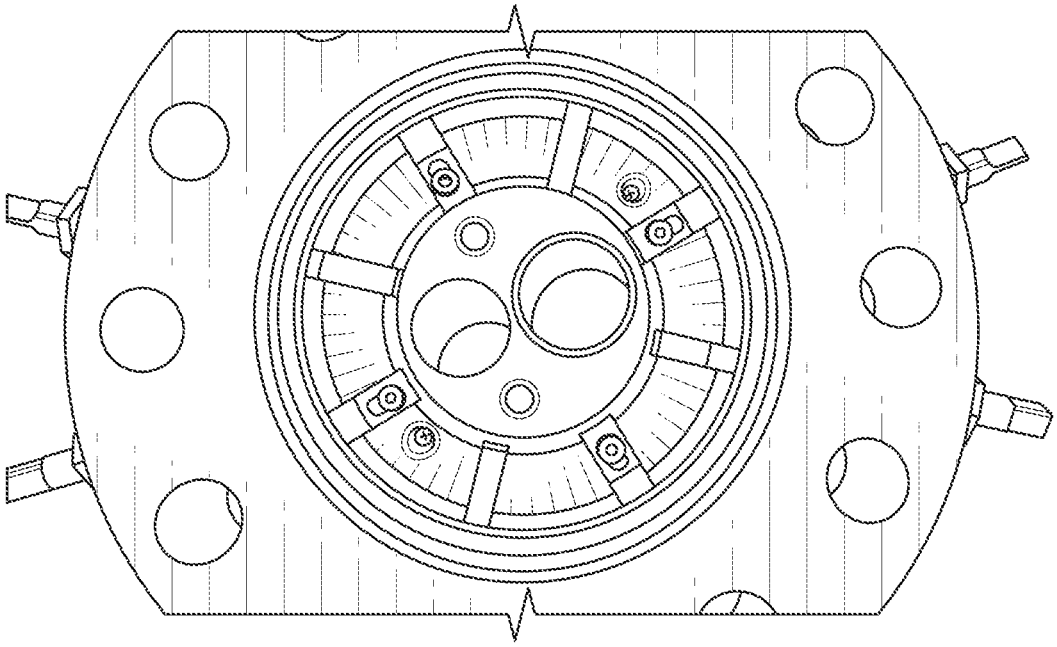
FIG. 18 is a top view of a tubing hanger secured by a lock-down mechanism and bowl reducer assembly installed in a tubing head in accordance with one embodiment of the present invention.

Each movable panel may further comprise an inner groove disposed longitudinally along said inner radial face and configured to receive a spring. Said spring may be a snap spring as depicted in FIG. 8. In such embodiments, a single snap spring is used with all movable panels receiving some portion of the spring's circumference in their respective inner grooves. In use, the spring is inserted into the inner grooves of the panels and serves to keep the panels in what is essentially a resting state spaced apart from one another until a force is applied to overcome the spring. This force may be applied to the outer radial faces of the movable panels. When such a force is applied, the panels are caused to move radially inward as shown in FIGS. 12 and 13. When such a force is removed, the panels are caused to move radially outward by the spring. As depicted in FIGS. 1, 4, and 10-12, each movable panel may comprise an outer groove configured to engage with at least one lockscrew wherein said lockscrew, or other similar structure, is disposed, as conventionally known, in the tubing head (or other tubing assembly or wellhead apparatus) into which the lock-down mechanism is installed. When said at least lockscrew is turned and engages with an outer groove of a movable panel, force may be exerted, via continual turning of the lockscrew, against said movable panel's outer radial face thereby causing said movable panel to move radially inward.

Each movable panel may further comprise a locking ridge on said inner radial face. Said locking ridge extends radially inward and is configured to engage with a tubing hanger in order to secure said tubing hanger within a tubing head as shown in FIGS. 1, 10, 11, and 13. When the tubing head lockscrews exert force on the movable panels' outer radial faces, the movable panels will move radially inward causing the locking ridges to engage with the sides of the tubing hanger. In certain embodiments, the locking ridges engage with a corresponding groove in the tubing hanger. When engaged to the tubing hanger, the lock-down mechanism secures the tubing hanger in place and prevents movement of the tubing hanger within the tubing head. To unlock the tubing hanger, the process of turning the lockscrews may be reversed thereby ceasing exertion of force against the outer radial walls. The spring will return to an uncompressed state causing the movable panels to move radially outward.

Figure 10:
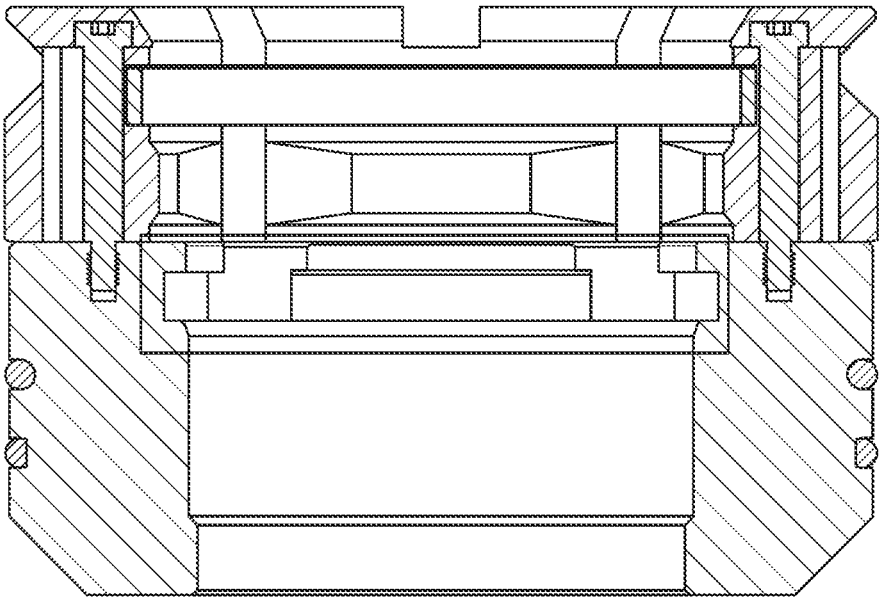
FIG. 10 is a cross-sectional side view of a lock-down mechanism and bowl reducer assembly in accordance with one embodiment of the present invention.

An embodiment of a bowl reducer is depicted in FIGS. 8 and 10. Said bowl reducer comprises a top surface, a bottom surface, an outer radial surface, a bore partially defined by an inner radial surface, and a seating surface disposed between said top surface and said bottom surface wherein said seating surface extends radially inward from said inner radial surface, as shown in FIGS. 8 and 11, to create a platform upon which a tubing hanger may rest as depicted in FIGS. 12 and 13. Consistent with the foregoing, said bore should be sized such that, when the lock-down mechanism's spring is an uncompressed state, a tubing hanger may pass between the lock-down mechanism's movable panels and partially through said bowl reducer before coming to rest on said seating surface of said bowl reducer.

Figure 22:
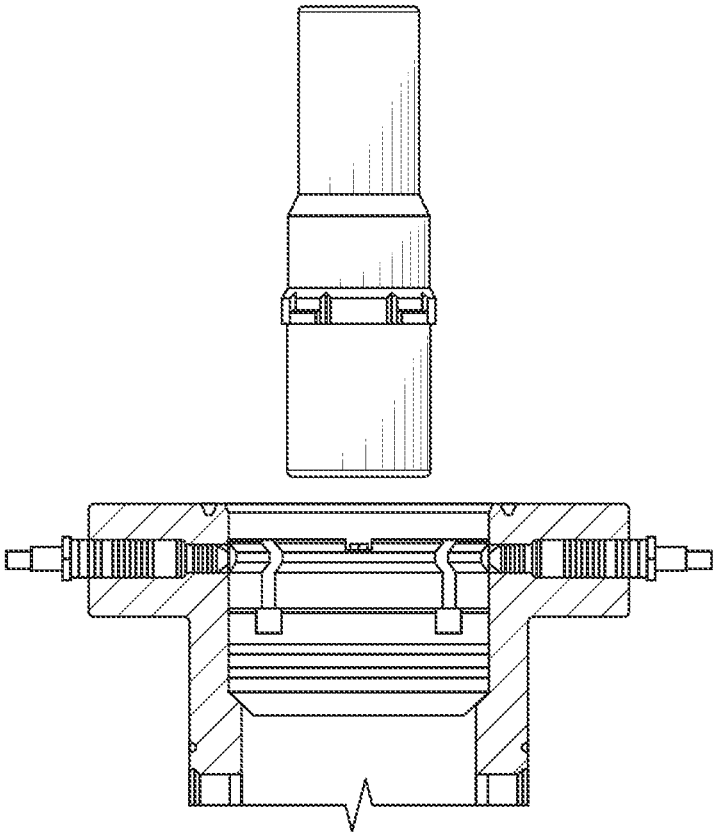
FIG. 22 is a cross-sectional side view of a lock-down mechanism and bowl reducer assembly installed in a tubing head and ready for removal in accordance with one embodiment of the present invention.
Figure 23:
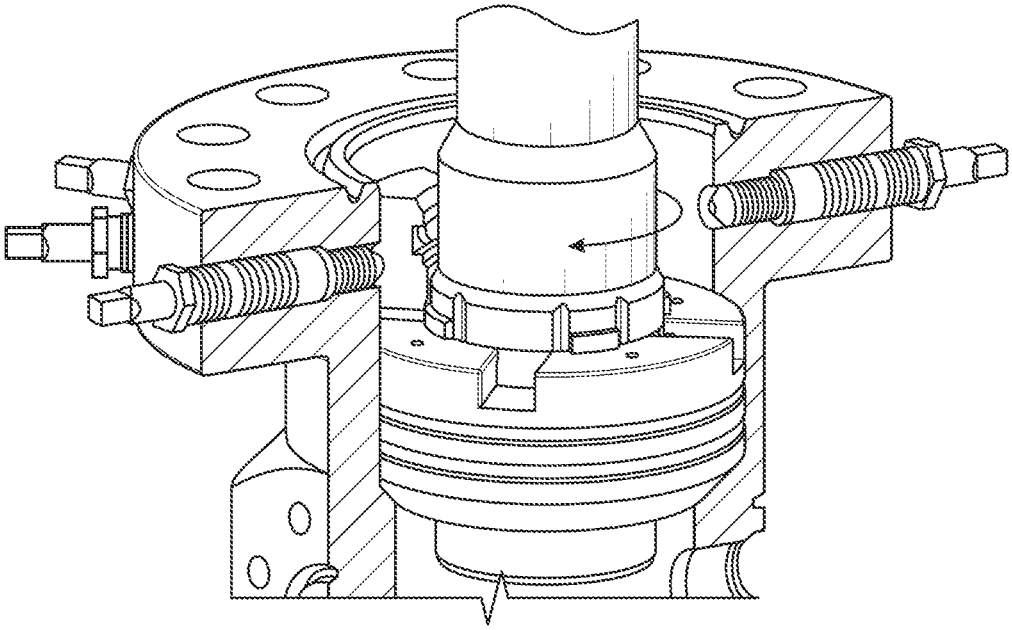
FIG. 23 is a cross-sectional perspective view of a running and retrieving tool being inserted into a lock-down mechanism and bowl reducer assembly in accordance with one embodiment of the present invention.
Figure 24:
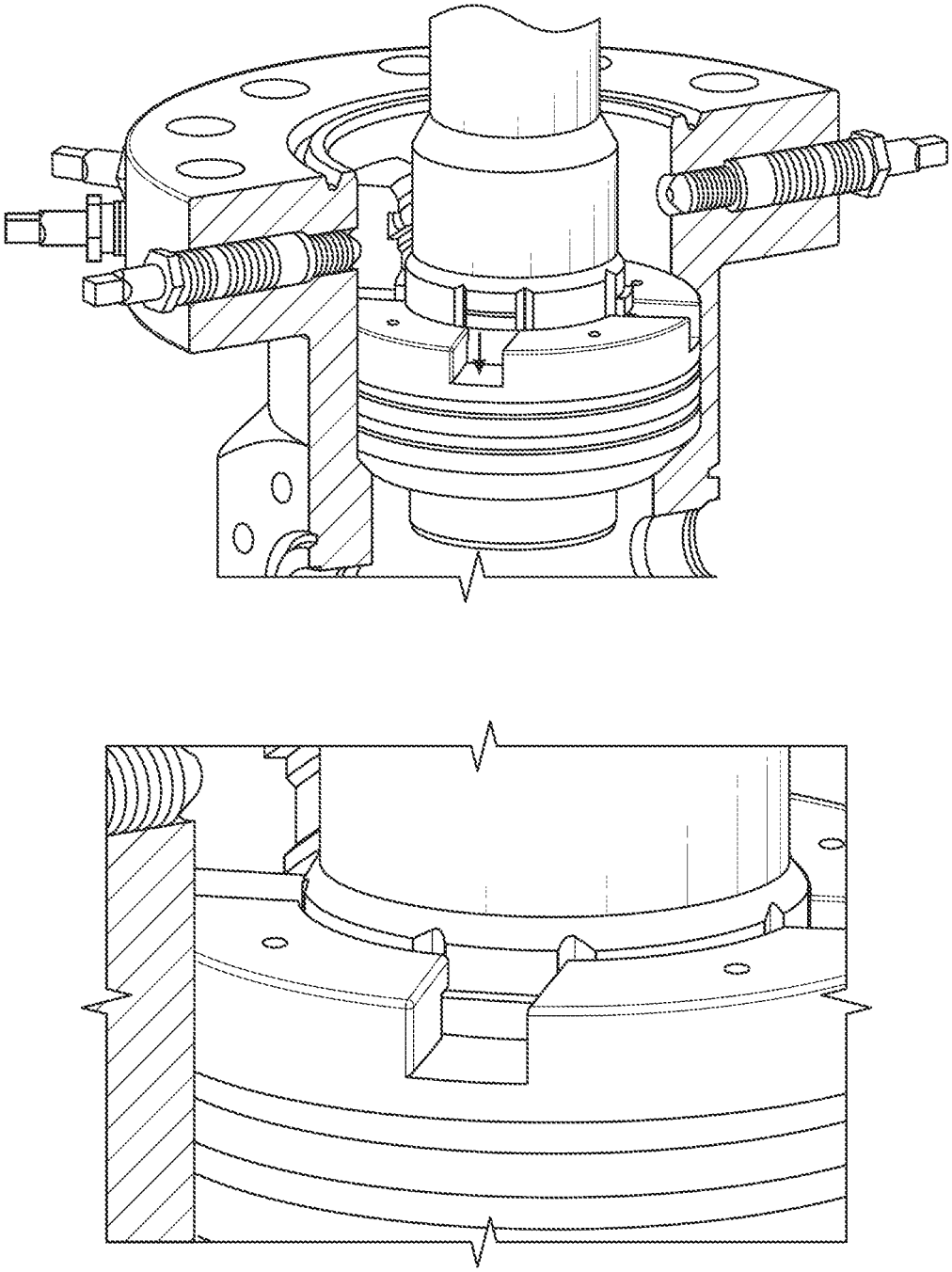
FIG. 24 is a cross-sectional perspective view of a running and retrieving tool being rotated in a lock-down mechanism and bowl reducer assembly in accordance with one embodiment of the present invention.
Figure 25:
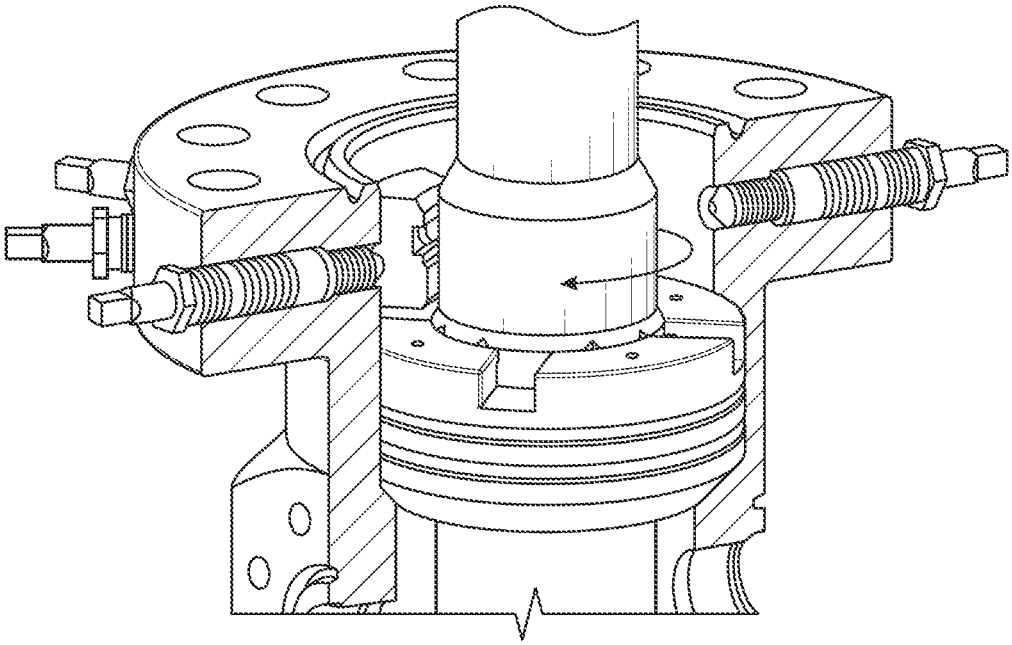
FIG. 25 is a cross-sectional perspective view of a running and retrieving tool engaging with the retrieval grooves of a bowl reducer in accordance with one embodiment of the present invention.
Figure 26:
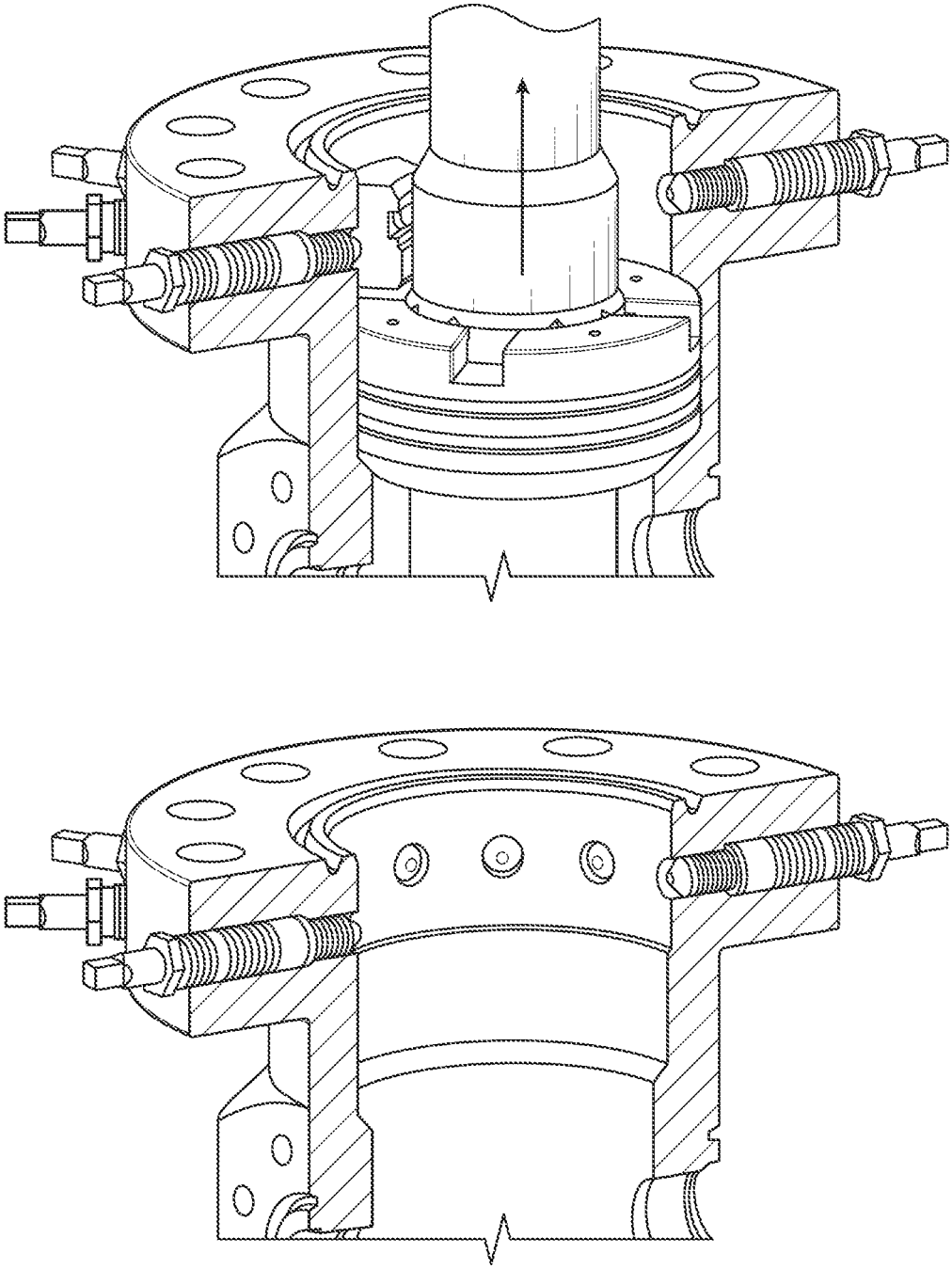
FIG. 26 is a cross-sectional perspective view of a running and retrieving tool removing a lock-down mechanism and bowl reducer assembly from a tubing head in accordance with one embodiment of the present invention.

The bowl reducer may be further configured with a retrieval geometry as depicted in FIGS. 20-26 in the form of retrieval slots in said top surface that extend downward toward said seating surface. Each of said retrieval slots may be configured to receive a protrusion on a running and retrieving ("R-N-R") tool as shown in FIGS. 22-24. The bowl reducer may further comprise a retrieval groove disposed along said inner radial surface of said bowl reduced wherein said retrieval groove is configured to engage with at least one protrusion on said R-N-R tool when said R-N-R tool is rotated, as shown in FIG. 25, after being lowered into said bowl reducer.

In further embodiments, said plurality of movable panels further comprises at least one removal hole. Said at least one removal hole may be formed into the top face of one or more movable panels. Said removal hole may be a ¾"-10 UN threaded hole configured to engage with a lifting eye.

One embodiment of a method for installing the lock-down mechanism and bowl reducer is here described.

The plurality of movable panels should first be secured to the bowl reducer with said plurality of shoulder bolts. While securing the movable panels, the spring is fit into the respective inner grooves of the movable panels. An operator should then ensure that any lockscrew pins in the tubing head are back out such that they are not exposed within the bore of the tubing head as exposed pins may prevent the lock-down mechanism from fitting into the tubing. Tubing head interior surfaces are optimally lightly greased to facilitate installation.

Two lifting eyes are then installed, at approximately 3-4 turns deep, into two removal holes in said movable panels. The lock-down mechanism and bowl reducer assembly is then lowered into the tubing head. Each lockscrew is tightened such that the end of the lockscrew is about 3⅝" from the outer surface of the spool's flange. The lockscrews should not yet be compressing the lock-down mechanism's spring.

Figure 19:
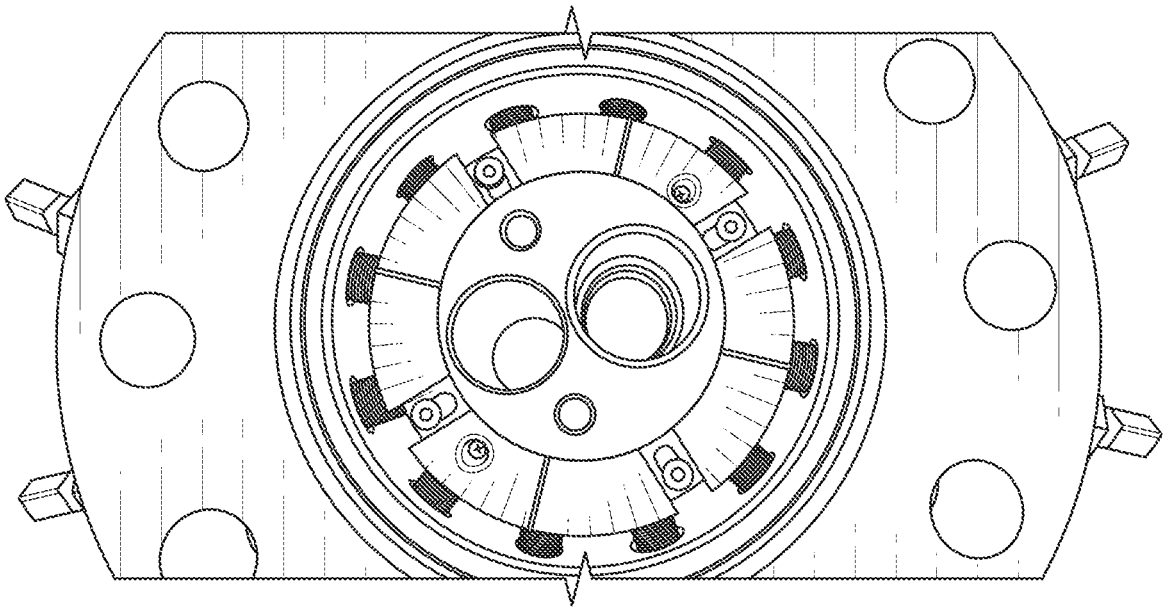
FIG. 19 is a is a top view of a tubing hanger disposed within a lock-down mechanism and bowl reducer assembly prior to engagement of the movable panels in accordance with one embodiment of the present invention.
Figure 20:
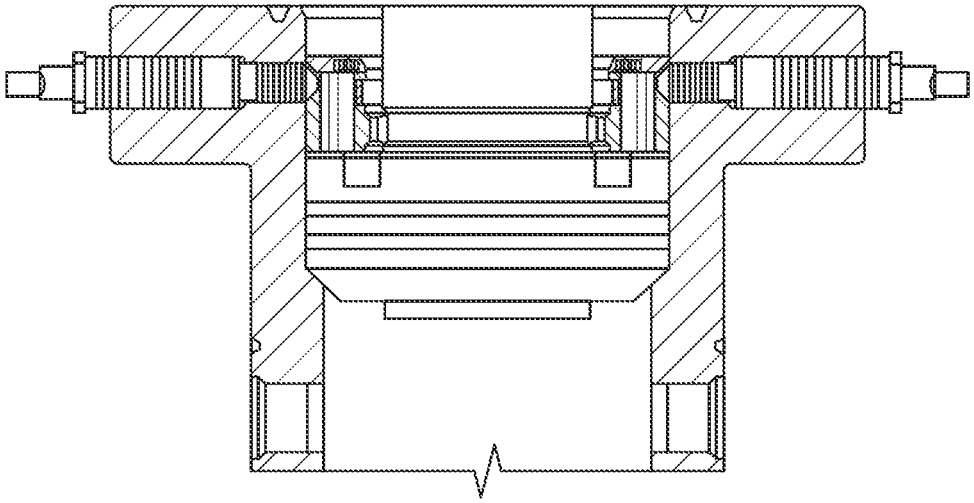
FIG. 20 is a cross-sectional side view of a tubing hanger disposed within a lock-down mechanism and bowl reducer assembly prior to removal of the tubing hanger in accordance with one embodiment of the present invention.
Figure 21:
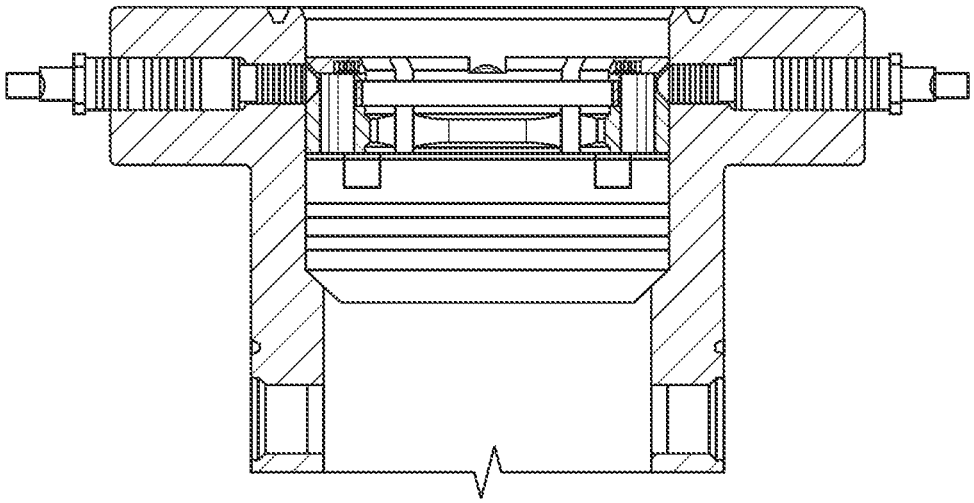
FIG. 21 is a cross-sectional side view of a lock-down mechanism and bowl reducer assembly after removal of a tubing hanger in accordance with one embodiment of the present invention.

The tubing hanger is then lowered into position, as shown in FIG. 19, to rest on the seating surface of the bowl reducer. Note that, for certain operations, a penetrator assembly should be built onto a pump cable and installed into the hanger prior to landing the hanger. Each lockscrew should be tightened, one at a time in a clockwise pattern, two full rotations. This is repeated until the movable panels have engaged the tubing hanger as described above. At this point, a wellhead adapter/toadstool may be assembled.

In the event that a larger hanger (10.990 max OD) is required, the lock-down mechanism and bowl reducer assembly may be removed. The lockscrews may thereafter be used in accordance to conventional methods. To remove the system, the steps are reversed until the lockscrews are no longer causing the movable panels to engage with the tubing hanger. The tubing hanger is then removed. In order to remove the lock-down mechanism and bowl reducer, a R-N-R tool is used. Prior to using the R-N-R tool, ensure that all lockscrew pins have been fully backed out of the tubing head such that they are not exposed in the bore. The R-N-R tool is then lowered over the wellhead assembly. Projections of the R-N-R tool will then land against the flat top surface of the bowl reducer created by the retrieval geometry as depicted in FIG. 24. The R-N-R tool is then rotated in order to engage the projections with the retrieval groove of the bowl reducer as shown in FIG. 25. The R-N-R tool is then lifted and will pull the lock-down mechanism and bowl reducer assembly from the tubing head.

Although the invention has been described with reference to specific embodiments, this description is not meant to be construed in a limited sense. Various modifications to the disclosed embodiments (including to the number of movable panels within the lock-down mechanism), as well as alternative embodiments of the present invention, will be apparent to persons skilled in the art upon reference to the description of the disclosed embodiments.

What is claimed is:

1. A pipe diameter reduction lock-down system comprising:

a locking assembly comprising:

a plurality of movable panels;

a plurality of shoulder bolts;

a spring;

a bowl reducer coupled to said locking assembly, wherein each movable panel of said plurality of movable panels comprises a bolt slot disposed axially between a top face and a bottom face of said each movable panel, wherein said bolt slot is configured to receive one shoulder bolt of said plurality of shoulder bolts, wherein said one shoulder bolt is configured to engage with said bowl reducer, wherein said bolt slot is further configured to allow movement of said each movable panel radially inward, and wherein said movement is substantially guided by said one shoulder bolt and said bolt slot.

2. The system of claim 1 wherein said each movable panel further comprises an inner groove disposed longitudinally along an inner radial face of said each movable panel, wherein said inner groove is configured to receive said spring.

3. The system of claim 2 wherein said each movable panel further is configured to move radially inward when a lateral force is applied to an outer radial face of said each movable panel.

4. The system of claim 3 wherein said outer radial face comprises an outer groove configured to engage with at least one lockscrew of a tubing head.

5. The system of claim 4 wherein said inner radial face comprises a locking ridge extending radially inward from said inner radial face, wherein said locking ridge is configured to engage with a corresponding groove in a tubing hanger.

6. The system of claim 5 wherein said bowl reducer comprises a top surface, a bottom surface, an outer radial surface, an inner radial surface, a bore partially defined by said inner radial surface, and a seating surface disposed between said top surface and said bottom surface wherein said seating surface extends radially inward from said inner radial surface.

7. The system of claim 6 wherein said bowl reducer is configured with retrieval geometry for facilitating removal of said locking assembly and said bowl reducer.

8. The system of claim 7 wherein said bowl reducer further comprises a retrieval groove disposed longitudinally along said inner radial surface, wherein said retrieval groove is configured to engage with at least one protrusion on a running and retrieving tool.

9. The system of claim 8 wherein said plurality of movable panels comprises four movable panels and wherein said spring is a snap spring.

* * * * *